US006404351B1

(12) United States Patent
Beinke

(10) Patent No.: US 6,404,351 B1
(45) Date of Patent: Jun. 11, 2002

(54) EMERGENCY VEHICLE WARNING SYSTEM

(76) Inventor: Dennis Beinke, 15301 NE. 64th Ct., Redmond, WA (US) 98052

( * ) Notice: Subject to any disclaimer, the term of this patent is extended or adjusted under 35 U.S.C. 154(b) by 0 days.

(21) Appl. No.: 09/693,109

(22) Filed: Oct. 20, 2000

(51) Int. Cl.[7] ..... G08G 1/00
(52) U.S. Cl. ..... 340/902; 340/904; 340/907
(58) Field of Search ..... 340/901, 902, 340/903, 904, 906, 907

(56) References Cited

U.S. PATENT DOCUMENTS

| | | | | | |
|---|---|---|---|---|---|
| 4,747,064 | A | * | 5/1988 | Johnston | 340/902 |
| 4,952,931 | A | * | 8/1990 | Serageldin et al. | 340/902 |
| 5,307,060 | A | * | 4/1994 | Prevulsky et al. | 340/902 |
| 5,495,242 | A | * | 2/1996 | Kick et al. | 340/902 |
| 5,677,684 | A | * | 10/1997 | McArthur | 340/902 |

* cited by examiner

*Primary Examiner*—Daniel J. Wu
(74) *Attorney, Agent, or Firm*—Goldstein & Lavas, P.C.

(57) ABSTRACT

An emergency vehicle warning system including a plurality of directional receivers disposed within each of the driver's vehicles. The receivers are directed in opposing directions to span 360 degrees. Each of the receivers is capable of receiving a single radio frequency. A directional display and speaker are disposed interiorly of each of the driver's vehicle. The directional display and speaker are in communication with the directional receivers. An omni-directional receiver is disposed within each of the traffic lights in communication with an operating light system thereof. The omni-directional receiver is capable of receiving a same radio frequency as the four directional receivers. The directional receivers in each traffic light in communication with an operating system there is capable of receiving a second frequency when activated. A transmitter is disposed within the emergency vehicle. The transmitter is in communication with the directional receivers drivers vehicle 12 and the omni-directional receiver whereby the transmitter generates the primary and secondary radio frequencies and directional receivers in the traffic light will receive the secondary frequency upon activation.

5 Claims, 2 Drawing Sheets

EMERGENCY VEHICLE WARNING SYSTEM

BACKGROUND OF THE INVENTION

The present invention relates to an emergency vehicle warning system and more particularly pertains to notifying all drivers that an emergency vehicle is approaching.

It is quickly becoming apparent that there is a need for a system that will alert drivers on the road that an ambulance, a fire truck, or other emergency vehicle is approaching in order to have the drivers pull their respective vehicle to the side of the road to allow the emergency vehicles to safely reach their destination as fast as possible. Too many drivers are unaware of emergency vehicles approaching due to a number of different criterion. Whether it is a radio playing too loudly or just driver's not paying attention, emergency vehicles are facing too many delays when needing to reach an emergency situation.

The present invention seeks to solve the abovementioned problems by providing a system that will allow an emergency vehicle to automatically signal to vehicles within a predetermined radius that they are approaching, as well as control any traffic lights that the emergency vehicle is approaching so that vehicles will stop at an intersection to allow the emergency vehicle to pass through without any potential accidents or need to slow down.

The use of communication systems is known in the prior art. More specifically, communication systems heretofore devised and utilized for the purpose of communicating with people in vehicles are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,238,778 to Ohsumi discloses a transmitter in an emergency vehicle capable of producing an omni-directional radio signal and triggering a receiver in a passenger vehicle with a variable intensity audible warning relative to the distance to the hazard. U.S. Pat. No. 4,212,085 to Vaillancour discloses means for providing a driver with visual indication relating to the direction of an emergency vehicle. U.S. Pat. No. 4,443,783 to Mitchell discloses means for emergency vehicles to control traffic lights using a radio signal. U.S. Pat. No. 4,775,865 to Smith discloses an additional system for controlling a traffic signal using a transmitter mounted on an emergency vehicle.

While these devices fulfill their respective, particular objective and requirements, the aforementioned patents do not describe an emergency vehicle warning system for notifying all drivers that an emergency vehicle is approaching.

In this respect, the emergency vehicle warning system according to the present invention substantially departs from the conventional concepts and designs of the prior art, and in doing so provides an apparatus primarily developed for the purpose of notifying all drivers that an emergency vehicle is approaching.

Therefore, it can be appreciated that there exists a continuing need for a new and improved emergency vehicle warning system which can be used for notifying all drivers that an emergency vehicle is approaching. In this regard, the present invention substantially fulfills this need.

SUMMARY OF THE INVENTION

In the view of the foregoing disadvantages inherent in the known types of communication systems now present in the prior art, the present invention provides an improved emergency vehicle warning system. As such, the general purpose of the present invention, which will be described subsequently in greater detail, is to provide a new and improved emergency vehicle warning system, which has all the advantages of the prior art and none of the disadvantages.

To attain this, the present invention essentially comprises four directional receivers disposed within each of the driver's vehicles. The receivers are directed in opposing directions to span 360 degrees. Each of the receivers are capable of receiving a single radio frequency. A directional display and speaker are disposed interiorly of each of the driver's vehicle. The directional display and speaker are in communication with the four directional receivers. The directional display includes illuminatable direction arrows. An omni-directional receiver is disposed within each of the traffic lights in communication with an operating light system thereof. The omni-directional receiver is capable of receiving a same radio frequency as the four directional receivers. The omni-directional receiver includes an audible alarm. A transmitter is disposed within the emergency vehicle. The transmitter is in communication with the four directional receivers and the omni-directional receiver whereby the transmitter generates the single radio frequency.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide new and improved emergency vehicle warning system, which has all the advantages of the prior art communication systems and none of the disadvantages.

It is another object of the present invention to provide a new and improved emergency vehicle warning system, which may be easily and efficiently manufactured and marketed.

It is a further object of the present invention to provide a new and improved emergency vehicle warning system, which is of durable and reliable construction.

An even further object of the present invention is to provide a new and improved emergency vehicle warning system which is susceptible of a low cost of manufacture with regard to both materials and labor, and which accordingly is then susceptible of low prices of sale to the consuming public, thereby making such emergency vehicle warning system economically available to the buying public.

Even still another object of the present invention is to provide a new and improved emergency vehicle warning system for notifying all drivers that an emergency vehicle is approaching.

Lastly, it is an object of the present invention to provide a new and improved emergency vehicle warning system including a plurality of directional receivers disposed within each of the driver's vehicles. The receivers are directed in opposing directions to span 360 degrees. Each of the receivers is capable of receiving a single radio frequency. A directional display and speaker are disposed interiorly of each of the driver's vehicle. The directional display and speaker are in communication with the directional receivers. An omni-directional receiver is disposed within each of the traffic lights in communication with an operating light system thereof. The omni-directional receiver is capable of receiving a same radio frequency as the four directional receivers. A transmitter is disposed within the emergency vehicle. The transmitter is in communication with the directional receivers and the omni-directional receiver whereby the transmitter generates the single radio frequency.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
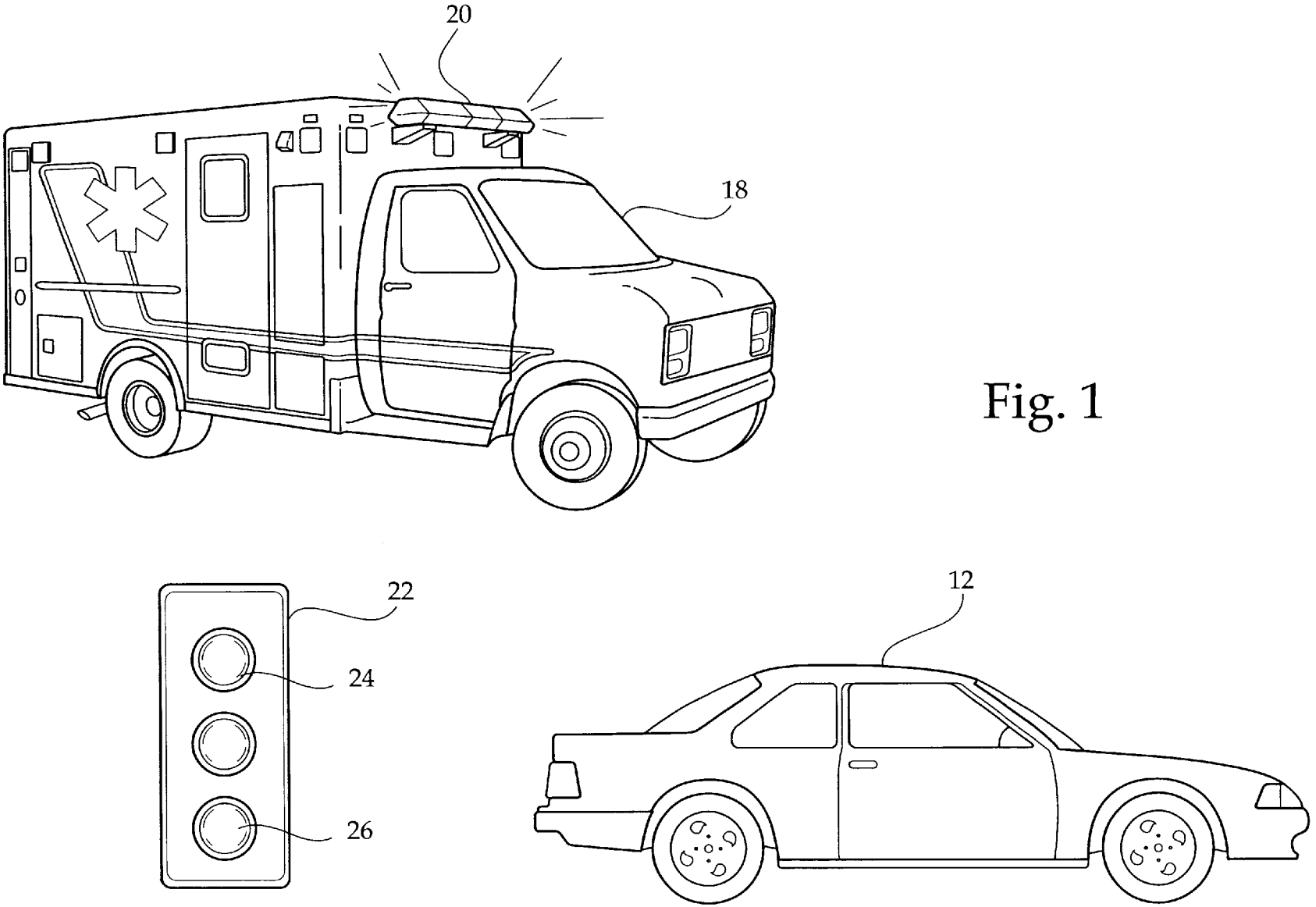
FIG. 1 is a perspective view of the preferred embodiment of the emergency vehicle warning system constructed in accordance with the principles of the present invention.
Figure 2:
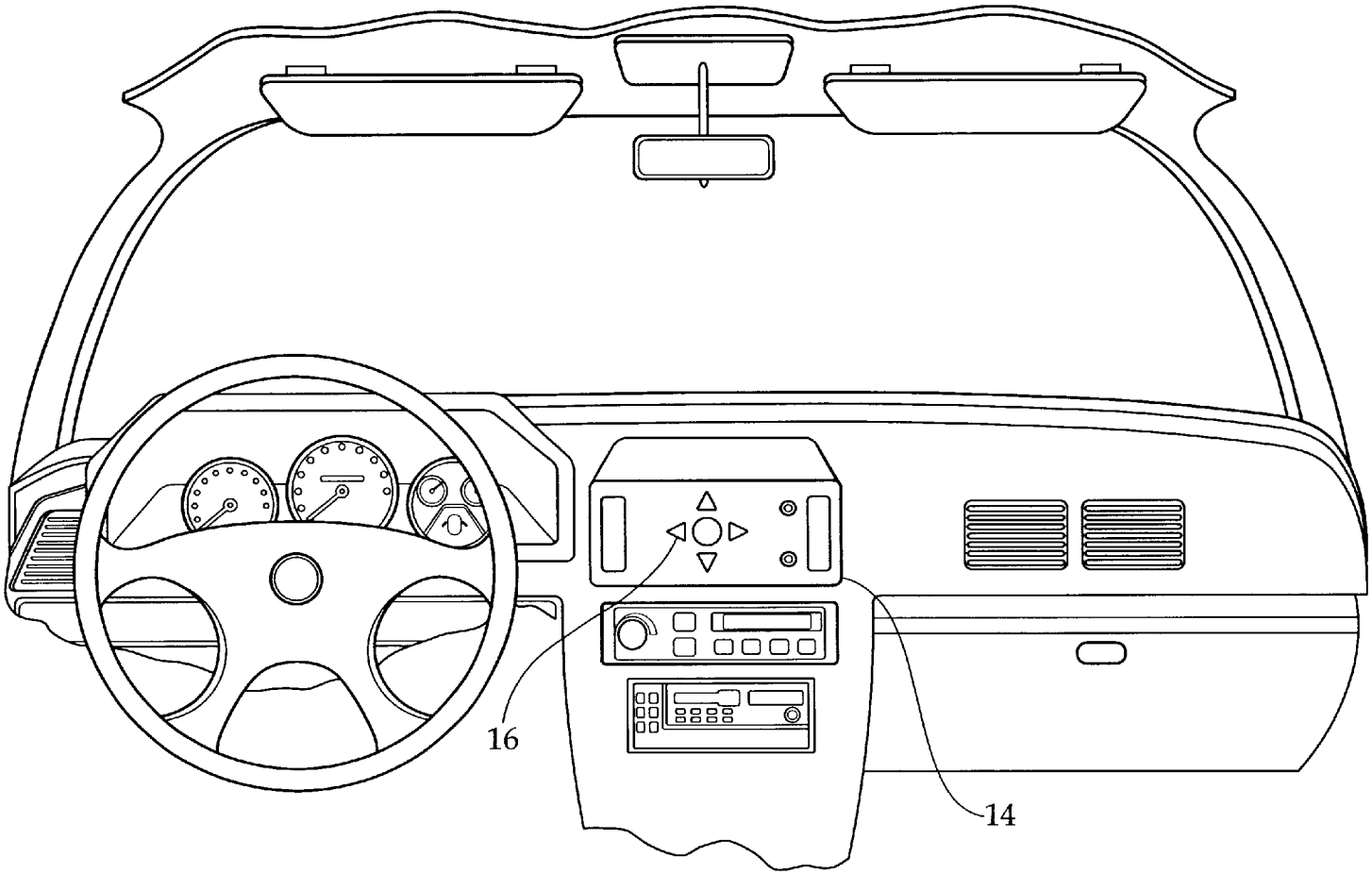
FIG. 2 is a front view of a dashboard of a vehicle shown with the directional display and speaker of the present invention mounted thereon.

With reference now to the drawings, and in particular, to FIGS. 1 through 2 thereof, the preferred embodiment of the new and improved emergency vehicle warning system embodying the principles and concepts of the present invention and generally designated by the reference number 10 will be described.

Specifically, it will be noted in the various Figures that the device relates to an emergency vehicle warning system for notifying all drivers that an emergency vehicle is approaching.

In its broadest context, the device consists of four directional receivers, a directional display and speaker, an omni-directional directional receiver, and a transmitter. Such components are individually configured and correlated with respect to each other so as to attain the desired objective.

The four directional receivers are disposed within each of the driver's vehicles 12. The receivers are directed in opposing directions to span 360 degrees. Each of the receivers is capable of receiving a single radio frequency. The receivers will be connected with the electrical system of the vehicle 12 so that they will be activated once the vehicle has been turned on. The receivers can also be equipped with a warning signal that can indicate to the driver that there is a problem with one, or more, receiver.

The directional display and speaker 14 are disposed interiorly of each of the driver's vehicle 12. The directional display and speaker 14 are in communication with the four directional receivers. The directional display includes illuminatable direction arrows 16. The arrows 16 will serve to indicate from what direction the emergency vehicle 18 is approaching.

The omni-directional receiver is disposed within traffic lights 22 in communication with an operating light system thereof. The omni-directional receiver is capable of receiving a same radio frequency as the four directional receivers. The omni-directional receiver includes an audible alarm. Once the omni-directional receiver receives a signal, it will cause a red light 24 on the traffic lights 22 to be shone in each direction to prevent any vehicles 12 from entering the intersection so as to allow the emergency vehicle 18 to pass safely through. Emergency vehicle 18 will also have capability to transmit to the traffic light 22 a second signal (a second frequency) which will change the red light 24 on the approach side from red 24 to green 26, allowing all blocking driver's vehicles 12 to proceed through the traffic light 22 clearing the intersection.

The transmitter is disposed within the emergency vehicle 18. The transmitter is in communication with the four directional receivers and the omni-directional receiver whereby the transmitter generates the single radio frequency. The transmitter will be connected with the emergency lights and sirens 20 so that when they are activated, the transmitter will be activated. The transmitter will send its signal forwardly spanning 180 degrees to a distance of about one-quarter (¼) of a mile.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An emergency vehicle warning system for notifying all drivers that an emergency vehicle is approaching, wherein the system works with the driver's vehicles and with traffic lights at intersections, the system comprising, in combination:

four directional receivers disposed within each of the driver's vehicles, the receivers being directed in opposing directions to span 360 degrees, each of the receivers being capable of receiving a single radio frequency; a directional display and speaker disposed interiorly of each of the driver's vehicles, the directional display and speaker being in communication with the four directional receivers, the directional display including illuminatable direction arrows; an omni-directional receiver disposed within each of the traffic lights in communication with an operating light system thereof, the omni-directional and directional receiver being capable of receiving a same radio frequency as the four directional receivers, the omni-directional receiver including an audible alarm, the directional receiver being capable of receiving a second radio frequency; and a transmitter disposed within the emergency vehicle, the transmitter being in communication with the four directional receivers and the omni-directional receiver, whereby the transmitter generates the single radio frequency to a secondary transmitter disposed in the emergency vehicle, the secondary transmitter being in contact with four directional receivers in the traffic light.

2. An emergency vehicle warning system for notifying all drivers that an emergency vehicle is approaching, wherein the system works with the driver's vehicles and with traffic lights at intersections, the system comprising, in combination:

a plurality of directional receivers disposed within each of the driver's vehicles, the receivers being directed in opposing directions to span 360 degrees, each of the receivers being capable of receiving a single radio frequency;

a directional display and speaker disposed interiorly of each of the driver's vehicles, the directional display and speaker being in communication with the directional receivers; an omni-directional receiver and a plurality of directional receivers to span 360 degrees disposed within each of the traffic lights in communication with an operating light system thereof, the omni-directional receiver being capable of receiving a same radio frequency as the four directional receivers, the directional receivers disposed in the traffic lights will be capable of receiving a second radio frequency to only activate the green light in that direction; and a transmitter disposed within the emergency vehicle, the transmitter being in communication with the directional receivers and the omni-directional receiver whereby the transmitter generates the single radio frequency and upon activation a second frequency.

3. The emergency vehicle warning system as set forth in claim 2, wherein the directional display includes illuminatable direction arrows.

4. The emergency vehicle warning system as set forth in claim 2, wherein the omni-directional receiver includes an audible alarm.

5. The emergency vehicle warning system as set forth in claim 2, wherein the directional receiver includes light change from red to green.

* * * * *